US005973437A

United States Patent [19]

Gradzki et al.

[11] Patent Number: 5,973,437

[45] Date of Patent: Oct. 26, 1999

[54] SCHEME FOR SENSING BALLAST LAMP CURRENT

[75] Inventors: Pawel M. Gradzki, Potomac, Md.; Ihor T. Wacyk, Briarcliff Manor, N.Y.

[73] Assignee: Philips Electronics North America Corporation, New York, N.Y.

[21] Appl. No.: 08/966,724

[22] Filed: Nov. 10, 1997

Related U.S. Application Data

[60] Provisional application No. 60/046,955, May 19, 1997.

[51] Int. Cl.[6] ..... H05B 37/02

[52] U.S. Cl. ..... 310/307; 315/219; 315/DIG. 7; 315/224

[58] Field of Search ..... 315/307, 219, 315/224, 291, DIG. 7

[56] References Cited

U.S. PATENT DOCUMENTS 4,256,992 3/1981 Luursema ..... 315/219
5,039,921 8/1991 Kakitani ..... 315/307
5,048,033 9/1991 Donahue ..... 315/307
5,075,602 12/1991 Overgoor et al. ..... 315/307
5,367,223 11/1994 Eccher ..... 315/219
5,466,992 11/1995 Nemirow et al. ..... 315/219

*Primary Examiner*—Michael B Shingleton
*Attorney, Agent, or Firm*—Bernard Franzblau

[57] ABSTRACT

A light source including a ballast characterized by a resonant frequency and including a reference bus and a transformer having a secondary winding. The fluorescent lamp is partially covered by a shield, connected to the reference bus and coupled to the secondary winding. The ballast further includes a current sensor connected between the secondary winding and reference bus for sensing current flow through at least the lamp including that portion of lamp current attributable to parasitic capacitances affecting the resonant frequency.

10 Claims, 1 Drawing Sheet

SCHEME FOR SENSING BALLAST LAMP CURRENT

CROSS-REFERENCE TO RELATED APPLICATION

This application claims the benefit of U.S. Provisional Application Ser. No. 60/046,955 filed May 19, 1997.

BACKGROUND OF THE INVENTION

This invention relates generally to a fluorescent lamp ballast and, more particularly, to a scheme for sensing ballast lamp current.

Conventional liquid crystal display (LCD) backlighting for a laptop computer is provided by a fluorescent lamp partially covered by a shield. The shield serves, in part, to redirect light produced by the lamp toward the LCD. The lamp is powered by a dimmable cold cathode fluorescent lamp (CCFL) ballast which includes a transformer. Since the shield can come into contact with various parts of the laptop including, but not limited to, the ballast inverter, the shield is connected to a reference bus (hereinafter referred to as "ground") for safety purposes.

The CCFL ballast typically includes circuitry for sensing of lamp current to monitor lamp current conditions. The sensing circuitry, which includes a sensing element between the lamp and ground, should sense lamp current under all lamp conditions to ensure stable lamp operation, free of flicker. The sensed lamp current serves as a feedback signal to a controller for driving the ballast inverter.

Parasitic capacitances associated with the shield and transformer make such sensing difficult. More particularly, current can flow from the high voltage terminal of the lamp through the lamp glass to the shield and ground so as to bypass the sensing element. Under such conditions, lower than actual lamp current is sensed making lamp control far more difficult.

Accordingly, it is desirable to provide a CCFL ballast which operates the lamp under more stable, flicker free conditions. The improved lamp sense circuitry should particularly address the parasitic capacitance affect attributable to the shield and transformer.

SUMMARY OF THE INVENTION

Generally speaking, in accordance with the invention a light source includes a ballast characterized by a resonant frequency. The ballast includes a reference bus and a transformer having a secondary winding. A fluorescent lamp is partially covered by a shield, connected to the reference bus and coupled to the secondary winding. The ballast further includes a current sensor connected between the secondary winding and reference bus for sensing current flow through at least the lamp including that portion of lamp current attributable to parasitic capacitances affecting the resonant frequency.

By positioning the current sensor between the secondary winding and reference bus, lamp current attributable to the parasitic capacitance of the shield will be sensed by the current sensor. Consequently, current flowing from the high voltage terminal of the lamp through the lamp glass to the shield and ground will not bypass the sensing element. The ballast controller, responsive to the sensed lamp current, will drive the ballast inverter so as to provide more stable, flicker free lamp operation.

In accordance with a feature of the invention, the shield is connected to the reference bus. The ballast further includes a discrete inductor. The resonant frequency of the ballast is based on the inductance of the discrete inductor, leakage inductance of the transformer, and parasitic capacitances associated with the transformer and shield.

In accordance with another feature of the invention, the current sensor, secondary winding and lamp form a closed loop. Preferably, the current sensor has a substantially fixed impedance and is typically substantially resistive. The light source can be used as the LCD backlight for a laptop computer.

Accordingly, it is an object of the invention to provide an improved CCFL ballast which operates a lamp under more stable, flicker free conditions.

It is another object of the invention to provide an improved CCFL ballast having lamp sense circuitry which particularly addresses the parasitic capacitance affect on lamp current attributable to the shield and transformer.

Still other objects and advantages of the invention, will, in part, be obvious and will, in part, be apparent from the specification.

The invention accordingly comprises several steps in a relation of one or more of such steps with respect to each of the others, and the device embodying features of construction, a combination of elements and arrangement of parts which are adapted to effect such steps, all is exemplified in the following detailed disclosure and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
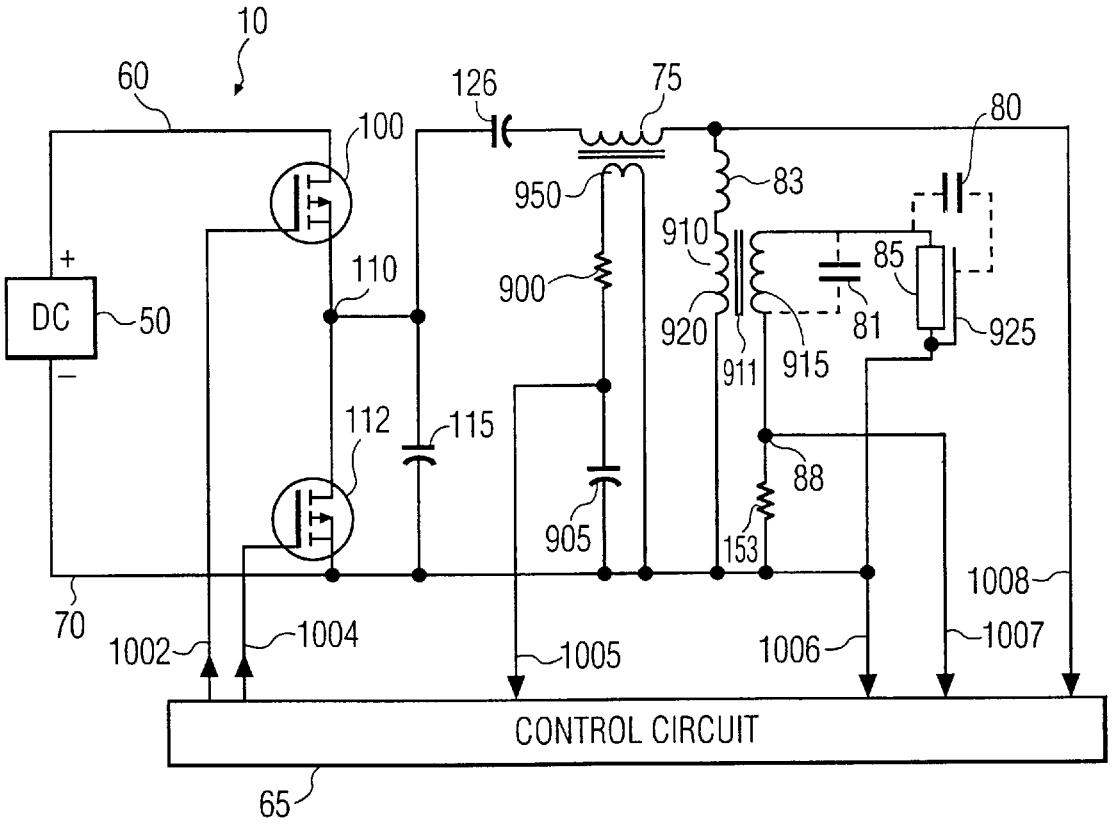
FIG. 1 is a schematic diagram of an inverter with lamp load in accordance with the invention.

As shown in FIG. 1, a ballast 10 is powered by a DC source 50 and is connected to a lamp 85. Lamp 85 can be, but is not limited to a fluorescent lamp of the cold cathode type, which is partially surrounded by a shield 925. The light from lamp 85 can be used to illuminate a liquid crystal display (LCD) of a computer (not shown). Shield 925 reflects light from lamp 85 toward the LCD. A portion of the electromagnetic interference (EMI) generated by lamp 85 is also blocked by shield 925 so as to minimize interfering with surrounding electrical devices. The parasitic capacitance between lamp 85 and shield 925 is represented by a parasitic capacitor 80.

Lamp 85 is connected to a secondary winding 915 of a transformer 910. The leakage inductance of transformer 910 is represented by leakage inductor 83. The parasitic capacitances associated with transformer 910 are represented by a capacitor 81. Parasitic capacitances associated with transformer 910 can exist between a primary winding 920 of transformer 910 and secondary winding 915, within secondary winding 915 and primary winding 920, between a ferrite core 911 of transformer 910 and secondary winding 915, between ferrite core 911 and primary winding 920 and between transformer 910 and ground.

A resonant circuit is formed by a resonant inductor 75, leakage inductor 83 and parasitic capacitors 80 and 81. Other than resonant inductor 75, there is no other discrete inductor or capacitor included which substantially affects the resonant frequency of the resonant circuit. There is also no discrete ballasting element, typically a capacitor, in series with lamp 85. The elimination of these discrete components from the resonant circuit or serially connected to lamp 85 reduces the parts count and cost of ballast 10. Power losses associated with these discrete components are also eliminated thereby improving the ballast efficiency.

A capacitor 126 is serially connected to resonant inductor 75. A pair of switches 100 and 112 are serially connected together across DC source 50 through a bus 60 and a reference bus 70. Bus 60 is at the high rail voltage. Reference bus 70 is at the low rail (common) voltage. Switches 100 and 112 are metal oxide semiconductor, field effect transistors (MOSFETs) which are joined together at a junction 110. A capacitor 115 is connected from a junction 110 to reference bus 70. Capacitor 126 is a blocking capacitor which filters the DC portion of a trapezoidal voltage produced at junction 110. Capacitor 115 slows down the voltage transition (dv/dt) across the drain-source voltage of each switch 100 and 115 and thereby facilitates turn on and turn off of each switch when the voltage thereacross is substantially zero (i.e. zero voltage switching).

The half-bridge switching circuit includes switches 100 and 112. These switches are turned on and off by a control circuit 65. A gating signal is supplied by control circuit along a gate line 1002 to control the conductive state of switch 100. A gating signal is supplied by control circuit 65 along a gate line 1004 to control the conductive state of switch 112. Switches 100 and 112 are never turned on at the same time. Each switch has an ON time duty ratio of slightly less than 50%. A small dead time Tdead during which both switches are turned off is required to permit the zero voltage switching to be implemented.

Control circuit 65 avoids operating near or below (capacitive mode) the resonant frequency by sensing the current flowing through resonant inductor 75. Half-bridge inverter operation is at a switching frequency above the resonant frequency. A resistor 900 and a capacitor 905 form an integration circuit for sensing the current flowing through resonant inductor 75. The voltage across capacitor 905, which is approximately equal to the integration of the voltage of a winding 950 coupled to inductor 75, represents the current through inductor 75. Control circuit 65 senses the zero-crossing of current flowing through inductor 75 through a signal supplied to control circuit 65 along a line 1005. Based, in part, on the zero-crossing timing, control circuit 65 determines the conduction time for switches 100 and 112.

Control circuit 65 regulates lamp power by sensing lamp current and lamp voltage. Lamp current is sensed by monitoring the voltage across a sensing resistor 153 (i.e. current sensor). Sensing resistor 153 is connected in series with secondary winding 915 and lamp 85 and forms a closed loop with secondary winding 915 and lamp 85. There are no discrete ballasting elements within this closed loop. A junction 88 joins secondary winding 915 to sensing resistor 85. The current flowing through lamp 85 is sensed by monitoring the voltage between junction 88 and ground.

The placement of sensing resistor 153 within the closed loop between secondary winding 915 and reference bus 70 permits total current flowing within the closed loop to be accurately sensed. More particularly, placement of sensing resistor 153 between junction 88 and ground as compared to, for example, between lamp 85 and ground provides a far more accurate reflection of total current including lamp current and parasitic currents flowing through parasitic capacitors 80 and 81. Lamp current attributable to the parasitic currents does not bypass sensing resistor 153. A more stable control loop with less potential for flicker is achieved. The sensing element preferably has a fixed resistive impedance.

The lamp current signal is supplied to control circuit 65 along a pair of lines 1007 and 1006. A more detailed description regarding the circuitry and operation of control circuit 65 can be found in pending U.S. patent application Ser. No. 08/642,686, filed May 3, 1996, which is incorporated herein by reference thereto.

As can now be readily appreciated, by positioning sensing resistor 153 between the secondary winding and reference bus, lamp current attributable to parasitic capacitance 80 of shield 925 will be sensed by sensing resistor 153. Consequently, current flowing from the high voltage terminal of lamp 85 through the lamp glass to shield 925 and reference bus 70 will not bypass sensing resistor 153. Control circuit 65, responsive to the sensed lamp current, will drive the ballast inverter so as to provide more stable, flicker free lamp operation.

It will thus be seen that the objects set forth above and those made apparent from the preceding description, are efficiently attained and since certain changes can be made in the above construction without departing from the spirit and scope of the invention, it is intended that all matter contained in the above description and shown in the accompanying drawings shall be interpreted as illustrative and not in a limiting sense.

We claim:

1. A light source, comprising:

a ballast characterized by a resonant frequency and including a reference bus and a transformer having a secondary winding; and a fluorescent lamp partially covered by a shield, connected to the reference bus and coupled to the secondary winding;

wherein the ballast further includes a current sensor connected between the secondary winding and reference bus for sensing current flow through at least the lamp including that portion of lamp current attributable to parasitic capacitances affecting the resonant frequency.

2. The light source of claim 1, wherein the shield is connected to the reference bus.

3. The light source of claim 1, wherein the current sensor senses current flowing through the secondary winding.

4. The light source of claim 1, wherein the parasitic capacitances are associated with the shield and transformer.

5. The light source of claim 1, wherein the ballast further includes a discrete inductor and wherein the resonant frequency of the ballast is based on the inductance of the discrete inductor, leakage inductance of the transformer, and parasitic capacitances associated with the transformer and shield.

6. The light source of claim 2, wherein the ballast further includes a discrete inductor and wherein the resonant frequency of the ballast is based on the inductance of the discrete inductor, leakage inductance of the transformer, and parasitic capacitances associated with the transformer and shield.

7. The light source of claim 1, wherein the current sensor, secondary winding and lamp form a closed loop.

8. The light source of claim 1, wherein the current sensor has a substantially resistive impedance.

9. The light source of claim 1, wherein the current sensor has a substantially fixed impedance.

10. A computer having a light source as claimed in claim 1.

* * * * *